US005600334A

United States Patent [19]

Whitehouse

[11] Patent Number: 5,600,334

[45] Date of Patent: Feb. 4, 1997

[54] MOBILE ANTENNA MOUNT

[75] Inventor: Glendon R. Whitehouse, Amherst, N.H.

[73] Assignee: Cushcraft Corporation, Manchester, N.H.

[21] Appl. No.: 516,788

[22] Filed: Aug. 18, 1995

[51] Int. Cl.[6] ..... H01Q 1/32; H01Q 1/12

[52] U.S. Cl. ..... 343/715; 343/888; 343/906

[58] Field of Search ..... 343/888, 906, 343/715, 711, 713, 878; H01Q 1/32, 1/12

[56] References Cited

U.S. PATENT DOCUMENTS

| | | | |
|---|---|---|---|
| D. 320,603 | 10/1991 | Jones | D14/238 |
| D. 321,886 | 11/1991 | Metivier | D14/238 |
| D. 334,570 | 4/1993 | Wingard | D14/238 |
| D. 363,070 | 10/1995 | Menzel et al. | D14/230 |
| 3,852,757 | 12/1974 | Kaiser | 343/906 |
| 4,090,030 | 5/1978 | Lagasse | 174/153 |
| 4,186,401 | 1/1980 | Altmayer | 343/906 |
| 4,243,989 | 1/1981 | Piper | 343/715 |
| 4,625,213 | 11/1986 | Horn | 343/715 |
| 4,755,822 | 7/1988 | Chesebro | 343/702 |
| 4,872,017 | 10/1989 | White | 343/715 |
| 5,214,434 | 5/1993 | Hsu | 343/906 |
| 5,218,370 | 6/1993 | Blaese | 343/906 |
| 5,229,784 | 7/1993 | Jones | 343/906 |

OTHER PUBLICATIONS

Sinclabs Inc., "Excelsior the New Standard of Excellence in Mobile Antennas", Apr. 25–27, 1995 Advertisement for Expo.

Maxrad, Inc., "Maxrad State of the Art Antennas", 1991, Catalog, Maxrad, Inc. No month.

Larsen brochure, Date Unknown.

*Primary Examiner*—Hoanganh T. Le

*Attorney, Agent, or Firm*—Hayes, Soloway, Hennessey, Grossman & Hage, P.C.

[57] ABSTRACT

A mobile antenna mount structure has a two-piece assembly including an upper chamber adapted to hold a whip-type antenna, and a lower chamber for holding a spring-loaded contact. The upper and lower chambers are separated from one another by a wall which prevents passage of water.

8 Claims, 2 Drawing Sheets

MOBILE ANTENNA MOUNT

FIELD OF THE INVENTION

This invention relates generally to antenna mounts. The invention has particular utility in connection with mobile antenna mounts, e.g. for whip-type antennas, and will be described in connection with such utility, although other utilities are contemplated.

BRIEF DESCRIPTION OF THE PRIOR ART

Previous to this disclosure, the prior art has provided several different mobile antenna mount device structures ranging from complex to simple in design. However, none of the prior art disclosures provide a design that has total weatherproof characteristics. Among the patents bearing on this particular concept will be found the following:

| Patentee | Pat. No. | Issue Date |
|---|---|---|
| White | 4,872,017 | Oct. 3, 1989 |
| Horn | 4,625,213 | Nov. 25, 1986 |
| Piper | 4,243,989 | Jan. 6, 1981 |
| Lagasse | 4,090,030 | May 16, 1978 |

These patents provide a mount structure to be used for a mobile antenna, either for a whip-type antenna as is disclosed in the White and Horn patents, a collapsible antenna as is disclosed in the Piper patent, or a CB antenna as is disclosed in the Lagasse patent. These disclosures, however, are inadequate in that they provide an antenna mount structure where moisture can leak from the outside to the inner structure of the device.

For example, the White patent utilizes a compression spring mechanism that provides an electrical contact at the lower end of the spring and, as a result of the downward pressure on the electrical contact when mounted on an appropriate base, produces a force at the upper end of the spring that compresses an O-ring that is disposed about a whip-type antenna, thereby acting as the weather seal. As is apparent, the integrity of the weather seal O-ring becomes dependent on the spring pressure exerted on the O-ring and the integrity of the O-ring itself. Also, the spring pressure on the O-ring is further dependent on the downward pressure of the electrical contact. When the height of the base to which the mount is attached varies, the amount of pressure on the O-ring also will vary, with the result that the effectiveness of the weather seal can be compromised due to varying compression of the O-ring.

The other patents cited here are similar in that there is direct communication between the outside elements, such as moisture, and the inner workings of the antenna mount structure. The result is that the electrical contacts and the spring device in these structures can be exposed to moisture that, over time, can reduce the integrity of such components.

SUMMARY OF THE INVENTION

It is thus a primary object of the present invention to provide a new and improved weatherproof mobile antenna mount structure that overcomes the aforesaid and other problems of the prior art.

Another object of the present invention to provide a weatherproof mobile antenna mount structure having a spring-loaded electrical contact assembly section which is completely sealed from the antenna receiving section.

These and other objects of the present invention are accomplished by a mobile antenna mount structure comprising a resiliently deformable outer housing, and a two-piece fitting defining two separate chambers is carried in the outer housing. One chamber of the inner housing is adapted for accommodating a compression spring mechanism for providing electrical contact when the mount is screwed on a base, while the other chamber is adapted for accommodating a whip antenna. The two chambers are electrically connected to one another, but are physically separated by a sealing wall, so that any moisture which may enter the antenna-containing chamber cannot leak down into the other chamber and compromise the spring-loaded contact or any other portion of the structure.

BRIEF DESCRIPTION OF THE DRAWINGS

These and other objects of the present invention, which will become apparent from the following detailed description taken in conjunction with the accompanying drawings.

DETAILED DESCRIPTION OF PREFERRED EMBODIMENTS

Figure 1:
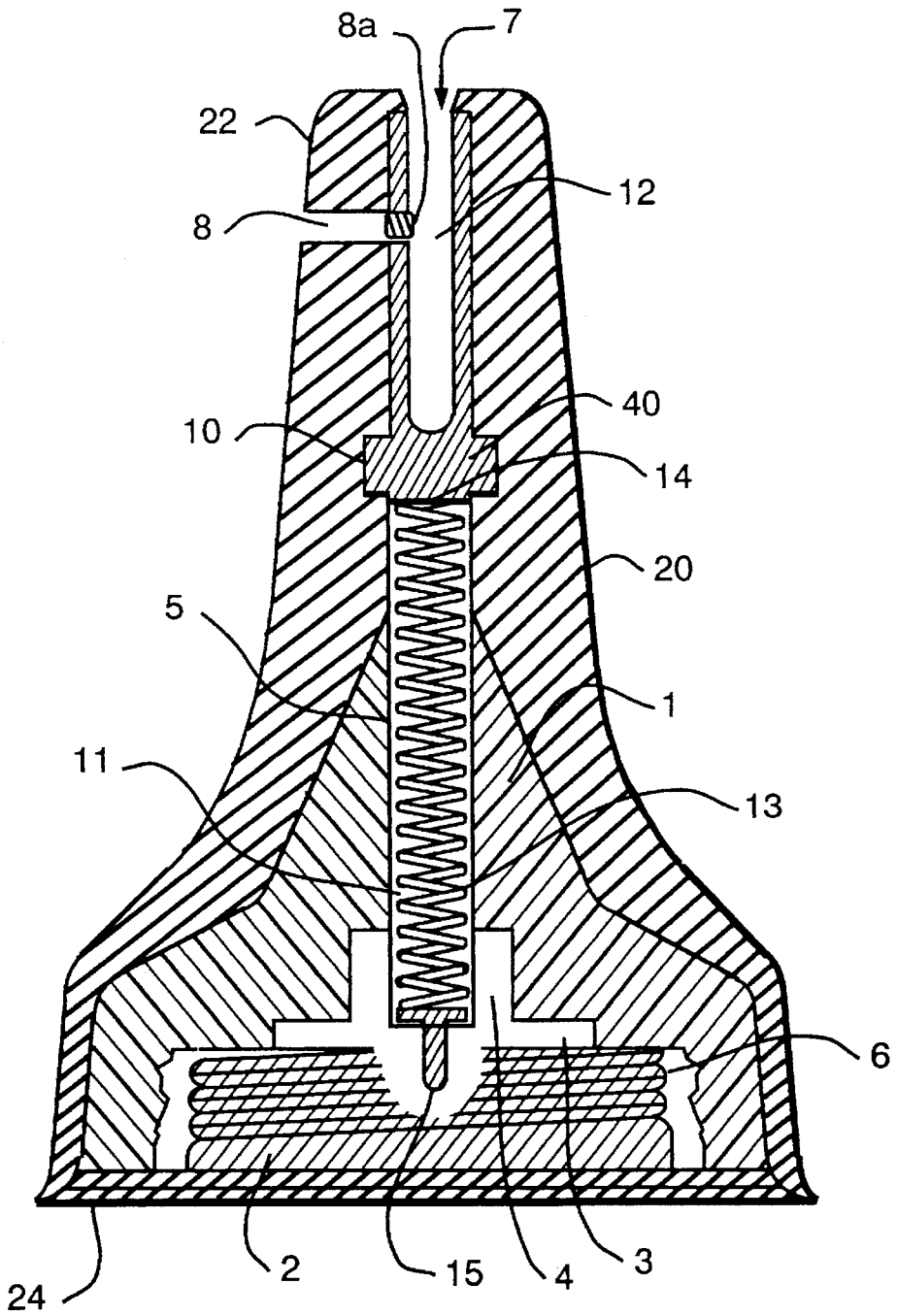
FIG. 1 shows a vertical cross-section of a preferred antenna mount made in accordance with the present invention.

Referring to the drawings, the weatherproof mobile antenna mount of the present invention comprises a one-piece molded inner housing 1 formed of a rigid plastic. Housing 1 includes a first cylindrical annular recess 2 for accommodating a threaded insert 6 for engaging a conventional antenna base structure (not shown), e.g. mounted on a vehicle. Insert 6 preferably is formed of a rust resistant metal such as brass. Alternatively, threads may be formed integrally in the sidewall of recess 2, e.g. by machining or molding. A second cylindrical stepped recess 3, 4, coaxial with recess 2, provides spacing between the first cylindrical recess 2 and a fourth cylindrical recess 5 which extends coaxially through the top of housing 1.

A two-piece fitting 11, 12, as will be described in detail below, is mounted in recess 5, and extends into stepped recess 3,4 at one end, and out through the top of housing 1. Housing 1 and fitting 11, 12 are carried within an outer housing 20 which is formed of a resiliently deformable plastic or rubber. Housing 20 includes a hole 7 in its top end which is roughly the diameter of a standard whip-type antenna (not depicted). A second hole 8 is provided, aligned with a corresponding threaded hole 22 in the side wall of fitting 12 for providing access to a set screw **8*a* mounted in threaded hole 22 for engaging and holding a conventional whip-type antenna, and to permit adjustment of the whip up and down to change its resonant length, and/or to release the whip-type antenna so that the antenna can be removed from the antenna mount structure. Housing 20 includes an integral lower lip 24 which surrounds the lower end of housing 1**, and provides an integral seal when the assembly is mounted onto a vehicle.

A feature and advantage of the present invention is to provide a watertight structure. This is accomplished, in part, by providing, in accordance with the present invention, a two-piece fitting 11,12, defining two separate chambers, one chamber 32 for accommodating a whip-antenna, and the other chamber 31 for accommodating a spring contact assembly. The two pieces 11, 12 are joined to one another, thereby creating an electrical continuity between the two pieces. While the two chambers 31, 32 are separated from one another by a wall which separates the two chambers.

Figure 2:
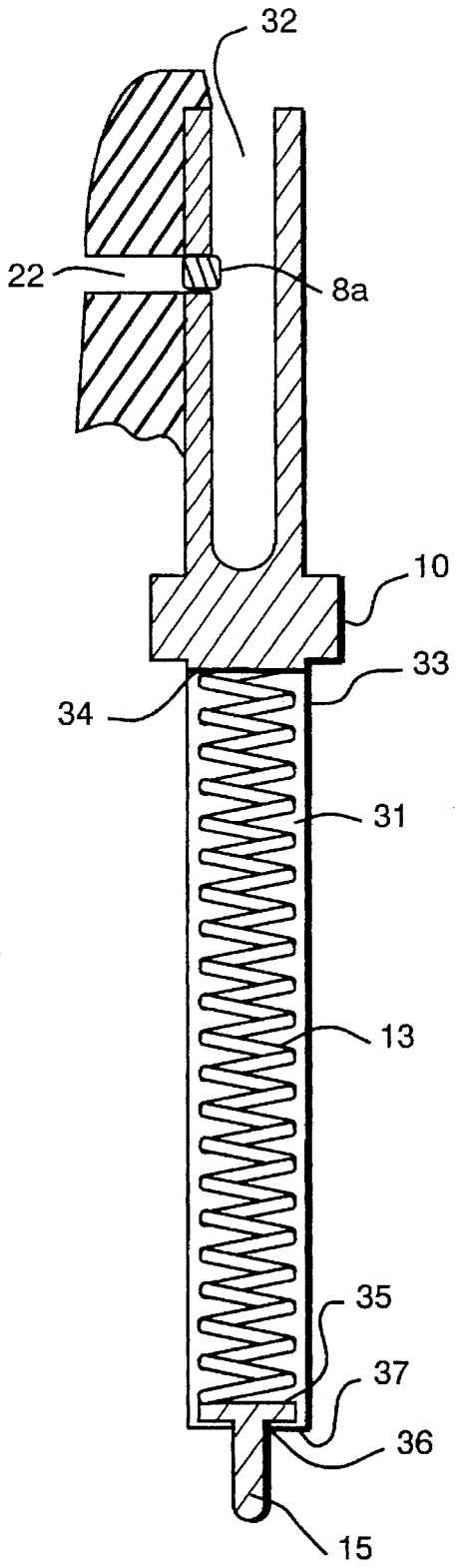
FIG. 2 is an enlarged view, similar to FIG. 1, and showing details of the two-piece fitting portion of the antenna mount.

Referring in particular to FIG. 2, fitting 11, 12 preferably comprises lower and upper hollow cylindrical members which are press-fitted together, at 33 to form a unitary, two piece assembly 11, 12. Lower piece 11 has disposed within chamber 31 a compression spring 13 that extends the full vertical length of the chamber 31, and bears at one end thereof against the top surface 35 of a contact pin 15, and at its other end by the bottom wall 34 of chamber 32. Contact pin 15 extends through an aperture 36 in the bottom wall 37 of chamber 31, and provides the necessary electrical connection to a conventional base structure (not shown). The top surface of contact pin 15 is flared so that when the compression spring 13 bears upon the contact pin 15, the upper portion of the contact pin 15 will remain within the lower member 31. The contact pin 15 is pushed upwardly against the compression spring 13 when the mount is screwed onto a base structure via internal threads 6.

Chamber 32 is in the shape of an elongate hollow cylinder having an i.d. sized to accommodate a conventional whip-type antenna, and is open at its top end, and closed at its bottom end by wall 34. A whip-type antenna (not shown) may be inserted into the upper chamber through the top opening 7 and extends downwardly to the bottom of the upper member 32. Once inserted, the whip-type antenna may be held in place via the set screw 8*a*.

Two-piece assembly 11, 12 also includes an outwardly directed flange 10 which may be formed integrally with one of the two pieces, for engaging with a recess 40 in housing 20 so as to locate and seal assembly 11, 12 in position in housing 20. Assembly 11, 12 is press-fitted together, and preferably is insert-molded in housing 1.

Housing 1 preferably is formed of a rigid plastic material such as ABS, while housing 20 preferably is made of a resiliently deformable and electrically insulative material such as Santoprene™. Insert 6 may be made of either metal or plastic, the choice of which will have no effect on the overall structure, while assembly 11, 12 should be found of metal or a metal filled plastic or the like so that it is an electrical conductor.

A feature and advantage of the present invention is that the ( mount is completely weatherproof due to the total weather isolation between the upper chamber 32 and the lower chamber 31. Moreover, the flexible nature of housing 20, coupled with the structural design of the housing 20, provides for weather-tight mounting without the need for washers or the like. Heretofore prior art antenna mounts relied on the interaction between an O-ring, disposed about the whip antenna, and a compression spring to effectuate a weather seal. The mount of the present invention provides a simple, low cost weatherproof design not possible with prior art designs.

What is claimed is:

1. A mobile antenna mount structure for mounting a whip-type antenna on a vehicle, comprising a two-piece, electrically continuous assembly defining a first and a second chamber, said first chamber adapted to accommodate a contact assembly, said second chamber adapted to accommodate a whip-type antenna, said first and second chamber being separated from one another by a wall, and a resiliently deformable housing surrounding and weatherproofing said two-piece electrically continuous assembly, said resiliently deformable housing including a lower lip which provides a seal when said two-piece continuous assembly is mounted on a vehicle, said two-piece assembly being mounted in a rigid housing with said rigid housing mounted in said resiliently deformable housing, and wherein said two-piece assembly includes an outwardly directed flange for engaging with a corresponding recess in said resiliently deformable housing.

2. A mobile antenna mount structure according to 1, wherein said wall is integral with and forms the bottom of said second chamber.

3. A mobile antenna mount structure as claimed in claim 2, wherein said contact assembly comprises a contact pin which protrudes through the bottom of said first chamber, said contact assembly further comprising a compression spring disposed within said first chamber and bearing at one end upon said contact pin and at the other end upon the wall separating said chambers.

4. A mobile antenna as claimed in claim 1, wherein said first and second chambers are press-fitted together to form said two-piece assembly.

5. A mobile antenna as claimed in claim 1, wherein said second chamber includes means for releasably locking therein a whip-type antenna.

6. A mobile antenna as claimed in claim 5, wherein said means for locking comprises a set screw.

7. A mobile antenna as claimed in claim 1, wherein said two-piece assembly is insert-molded in said rigid housing.

8. In a mobile antenna as claimed in claim 1, the improvement wherein said outwardly directed flange seals said two-piece assembly in said resiliently deformable housing.

* * * * *